US008201435B2

(12) United States Patent
Erlenmaier

(10) Patent No.: US 8,201,435 B2
(45) Date of Patent: Jun. 19, 2012

(54) PLATE WORKPIECE PROCESSING TOOLS AND MACHINES

(75) Inventor: Werner Erlenmaier, Gerlingen (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 721 days.

(21) Appl. No.: 12/424,802

(22) Filed: Apr. 16, 2009

(65) Prior Publication Data

US 2009/0223273 A1 Sep. 10, 2009

Related U.S. Application Data

(63) Continuation of application No. PCT/EP2007/008449, filed on Sep. 28, 2007.

(30) Foreign Application Priority Data

Oct. 18, 2006 (DE) ..... 10 2006 049 046

(51) Int. Cl.
*B21J 13/08* (2006.01)
*B26D 5/02* (2006.01)

(52) U.S. Cl. ..... 72/442; 72/446; 83/552

(58) Field of Classification Search ..... 72/441, 72/442, 444, 446–448; 83/552
See application file for complete search history.

(56) References Cited

U.S. PATENT DOCUMENTS 4,555,966 A 12/1985 Klingel
4,569,267 A * 2/1986 Klingel ..... 83/552
5,072,620 A * 12/1991 Hill et al. ..... 83/552
5,848,563 A * 12/1998 Saito ..... 83/552

FOREIGN PATENT DOCUMENTS

| | | |
|---|---|---|
| DE | 32 41 046 | 5/1984 |
| DE | 100 12 178 | 9/2000 |
| DE | 102005005214 | 8/2006 |
| GB | 2 349 597 | 11/2000 |

OTHER PUBLICATIONS

Office Action from corresponding Chinese Patent Application No. 200780038662.6, mailed Jul. 1, 2010, with English translation, 12 pages.
International Search Report for corresponding PCT Application No. PCT/EP2007/008449, mailed Jan. 8, 2008, 9 pages.
International Preliminary Report on Patentability from corresponding PCT Application No. PCT/EP2007/008449, mailed Apr. 22, 2009, 7 pages.
English translation of International Preliminary Report on Patentability from corresponding PCT Application No. PCT/EP2007/008449, mailed May 5, 2009, 7 pages.

* cited by examiner

*Primary Examiner* — Debra Sullivan
(74) *Attorney, Agent, or Firm* — Fish & Richardson P.C.

(57) ABSTRACT

Machines and tools that can be used to process (e.g., to cut and/or form) plate-like workpieces, such as metal sheets. In some aspects, a plate workpiece processing tool includes a first tool portion, which is drivingly connectable to a stroke drive, and a second tool portion. The tool has at least one processing device on the first tool portion and at least two counter-devices on the second tool portion. By using an activating device provided on the second tool portion, different device pairings can be activated for workpiece processing.

18 Claims, 3 Drawing Sheets

PLATE WORKPIECE PROCESSING TOOLS AND MACHINES

CROSS REFERENCE TO RELATED APPLICATIONS

This application is a continuation of and claims priority under 35 U.S.C. §120 to PCT Application No. PCT/EP2007/008449, filed on Sep. 28, 2007, which claimed priority to German Application No. 10 2006 049 046.0, filed Oct. 18, 2006. The contents of both of these priority applications are hereby incorporated by reference in their entirety.

TECHNICAL FIELD

This invention relates to machines and tools that can be used to process (e.g., to cut and/or form) plate-like workpieces, such as metal sheets.

BACKGROUND

DE-A-10 2005 005 214 describes a type of tool, referred to as a "multitool," that includes an upper tool that is drivingly connected to a stroke drive and that has several male punching/forming dies of various shapes. An associated lower tool has a corresponding number of female punching/forming dies, the geometry of which corresponds to that of the respective male dies associated therewith.

In order to activate a male die/female die pairing for workpiece processing, the upper tool's male die that is part of the male die/female die pairing to be activated is transferred into a position in which it projects towards the workpiece relative to the other male dies. To achieve this, an activating device is provided on the upper tool, which is drivingly connected to a stroke drive.

SUMMARY

In one aspect of the invention, a plate workpiece processing tool includes a first tool portion that is drivingly connectable to a stroke drive, and a second tool portion. The first tool portion and the second tool portion can be associated with sides of a workpiece to be processed that lie opposite each other along a stroke axis along which the first tool portion is driven. The plate workpiece processing tool further includes at least one processing device on the first tool portion and at least two counter-devices on the second tool portion. A processing device of the first tool portion is movable along the stroke axis towards a counter-device of the second tool portion for the purpose of workpiece processing. An activating device is provided on the second tool portion. Rotating a rotationally adjustable activating member about an activating rotational axis can cause the activating device to transfer a counter-device that is part of a processing device and counter-device pairing to be activated into an operating position in which, relative to a non-operating position that it can assume, the relevant counter-device projects towards the workpiece during workpiece processing.

In the above-described aspect of the invention, the activating device is provided, not on the tool portion that is drivingly connectable to a stroke drive, but, rather, on the second tool portion. By the activating rotational movement of the rotationally adjustable activating member, the counter-device that is part of the device pairing to be activated is transferred into an operating position. In its operating position, during workpiece processing, the relevant counter-device projects towards the workpiece relative to its position in a non-operating state.

The counter-devices are, when necessary for workpiece processing, located in their operating position close to the workpiece, and, when not required for workpiece processing, are located in their non-operating position away from the workpiece. Consequently, undesirable influences of the counter-devices that are not required during the relevant workpiece processing can be avoided. For example, when using counter-devices that, during workpiece processing, penetrate into the workpiece in the direction towards the first tool portion connected to a stroke drive, the counter-devices that are not required and that are not part of the activated device pairing are prevented from acting on the workpiece in an undesirable manner. The tool, can carry out workpiece processing operations that cannot be carried out with tools of the prior art without a tool change. Furthermore, the tool has only a slightly interfering contour in the immediate vicinity of the workpiece.

In some embodiments, an additional activating device is provided on the first tool portion. Thus, disturbing influences of processing devices that are not part of the activated device pairing are avoided.

In some embodiments, due to the position of the workpiece to be processed relative to the counter-devices, the second tool portion forms a workpiece support on its side associated with the workpiece.

In some embodiments, the workpiece support provided on the second tool portion acts as a workpiece stripper. As a result, an operationally reliable removal of the counter-devices from the workpiece after workpiece processing can be achieved.

In some embodiments, at least one counter-device is transferable into its non-operating position under the effect of gravity. In such embodiments, it is possible to dispense with some tool elements, such as restoring springs.

In some embodiments, at least one counter-device is in the form of a male processing die (e.g., a male forming die). Therefore, multitools can be used for producing shapings or protrusions extending out of the workpiece plane in the direction towards the first tool portion connected to a stroke drive. If the second tool portion is the lower tool portion, shapings or protrusions in an upward direction are consequently possible. Upwardly directed shapings or protrusions may have the advantage over downward shapings or protrusions in that they do not collide with a workpiece table supporting the workpiece.

In some embodiments, the counter-devices follow each other about the activating rotational axis. As a result, the tool can be relatively compact. Alternatively or in addition, a similar arrangement can be used for the processing devices.

In some embodiments, the activating rotational movement is carried out about a rotational axis of the tool about which the tool portions are rotatable by the rotary drive. Thus, rotary tool drives can be used to provide the activating rotational movement.

In some embodiments, an indexing-switching device for the second tool portion is provided on the machine tool. Using the indexing-switching device, either an activating rotational movement of the rotationally adjustable activating member or a common rotational movement of the counter-devices and of the rotationally adjustable activating member can be brought about in a simple manner.

In some embodiments, a corresponding indexing-switching device is provided for the first tool portion. Consequently, both the portion of the rotary drive for the first tool portion and the portion of the rotary drive for the second tool portion can be used for the activating rotational movement and the relevant common rotation of the tool portions.

In some embodiments a stroke drive is also provided for the second tool portion. Depending on the type of workpiece processing, a working stroke can be carried out by the stroke drive for the first tool portion and/or by the stroke drive for the second tool portion.

In another aspect of the invention, a plate workpiece processing tool includes a first tool portion that is drivingly connectable to a stroke drive. The stroke drive is configured to move the first tool portion along a stroke axis. The plate workpiece processing tool also includes a second tool portion. The first tool portion and the second tool portion are movable relative to one another along the stroke axis so that a plate workpiece can be positioned between the first tool portion and the second tool portion. The plate workpiece processing tool further includes a processing device connected to the first tool portion and at least two counter-devices connected to the second tool portion. Each of the at least two counter-devices is selectively alignable with the processing device. A first rotatable activating member is connected to the second tool portion. The first rotatable activating member is configured to move one of the at least two counter-devices into an operating position when the first rotatable activating member is rotated to a first position, and the first rotatable activating member is configured to move another of the at least two counter devices into an operating position when the first rotatable activating member is rotated to a second position. The at least two counter-devices project towards the first tool portion to a greater extent when in the operating position than when in a non-operating position. The processing device is movable towards the second tool portion in a direction substantially parallel to the stroke axis such that, when one of the at least two counter-devices is aligned with the processing device and is positioned in its operating position, the aligned processing device and counter-device can process a workpiece positioned between the first and second tool portions.

In some embodiments, at least two processing devices and a second rotatable activating member are connected to the first tool portion. The second rotatable activating member is configured to move one of the at least two processing devices into an operating position when the second rotatable activating member is rotated to a first position, and the second rotatable activating member is configured to move another of the at least two processing devices into an operating position when the second rotatable activating member is rotated to a second position, and the at least two processing devices project towards the second tool portion to a greater extent when in the operating position than when in a non-operating position.

In some embodiments, when one of the at least two processing devices is aligned with one of the at least two counter-devices, the first and second rotatable members can be positioned so that the aligned processing device and counter-device are in their operating positions.

In some embodiments, the second tool portion includes a workpiece support facing the first tool portion.

In some embodiments, the second tool portion is configured so that the workpiece support can strip a workpiece from the counter-device after workpiece processing.

In some embodiments, the second tool portion includes a resilient member disposed between the workpiece support and a base of the second tool portion, and the resilient member is configured to move the workpiece support away from the base.

In some embodiments, at least one of the counter-devices is configured to be moved into its non-operating position by gravity.

In some embodiments, at least one of the counter-devices is in the form of a male processing die (e.g., a male forming die).

In some embodiments, the counter-devices are arranged to follow each other around an axis about which the first activating member rotates when the first activating member is rotated.

In some embodiments, the first tool portion is positioned above the second tool portion.

In a further aspect of the invention, a plate workpiece processing machine includes a rotary drive and a tool. The tool includes a first tool portion that is drivingly connected to a stroke drive. The stroke drive is configured to move the first tool portion along a stroke axis. The tool further includes a second tool portion. The first tool portion and the second tool portion are movable relative to one another along the stroke axis so that a plate workpiece can be positioned between the first tool portion and the second tool portion. The tool also includes a processing device connected to the first tool portion and at least two counter-devices connected to the second tool portion. Each of the at least two counter-devices is selectively alignable with the processing device. A first rotatable activating member is connected to the second tool portion and configured to be rotated by the rotary drive. The first rotatable activating member is configured to move one of the at least two counter-devices into an operating position when the first rotatable activating member is rotated by the rotary drive to a first position, and the first rotatable activating member being configured to move another of the at least two counter devices into an operating position when the first rotatable activating member is rotated by the rotary drive to a second position. The at least two counter-devices project towards the first tool portion to a greater extent when in the operating position than when in a non-operating position. The processing device is movable towards the second tool portion in a direction substantially parallel to the stroke axis such that, when one of the at least two counter-devices is aligned with the processing device and is positioned in its operating position, the aligned processing device and counter-device can process a workpiece positioned between the aligned processing device and counter-device.

In some embodiments, the first rotatable activating member and the first and second tool portions are rotatable about a rotational axis of the tool by the rotary drive.

In some embodiments, the machine further includes an indexing-switching device connected to the second tool portion. The indexing-switching device is moveable between first and second switching states. In the first switching state, the counter-devices and the rotatable activating member are rotationally fixed relative to one another and are rotatable by the rotary drive and, in the second switching state, the counter-devices and the rotatable activating member are rotatable relative to each other with a rotational movement provided by the rotary drive.

In some embodiments, at least two processing devices and a second rotatable activating member are connected to the first tool portion. The second rotatable activating member is configured to move one of the at least two processing devices into an operating position when the second rotatable activating member is rotated by the rotary drive to a first position, and the second rotatable activating member is configured to move another of the at least two processing devices into an operating position when the second rotatable activating member is rotated by the rotary drive to a second position, and the at least two processing devices project towards the second tool portion to a greater extent when in the operating position than when in a non-operating position.

In some embodiments, when one of the at least two processing devices is aligned with one of the at least two counter-devices, the first and second rotatable members can be positioned so that the aligned processing device and counter-device are in their operating positions.

In some embodiments, the machine further includes an indexing-switching device connected to the first tool portion. The indexing-switching device is moveable between first and second switching states. In the first switching state, the processing devices and the rotatable activating member are rotatably fixed relative to one another and are rotatable by the rotary drive and, in the second switching state, the processing devices and the rotatable activating member are rotatable relative to each other with a rotational movement provided by the rotary drive.

In some embodiments, the machine further includes a stroke drive connected to the second tool portion. The stroke drive is configured to move the second tool portion along the stroke axis.

In addition to the advantages discussed above, aspects of the invention can result in increased efficiency of workpiece processing.

Other aspects, features, and advantages will be apparent from the description and drawings, and from the claims.

DETAILED DESCRIPTION

Figure 1:
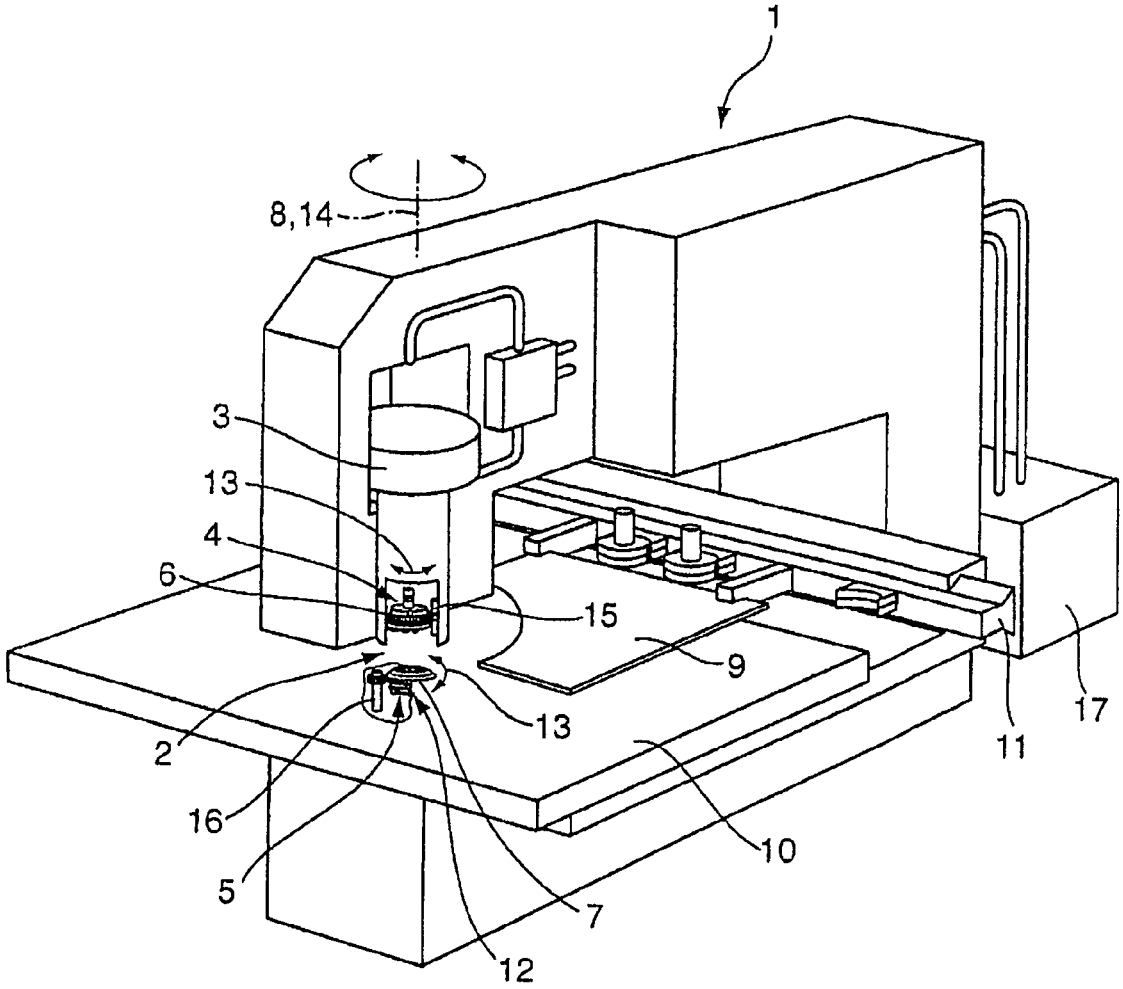
FIG. 1 is a diagrammatic representation of a machine including a tool for forming metal sheets.

According to FIG. 1, a machine tool 1 includes a tool 2 having a first tool portion in the form of an upper tool 4 drivingly connected to a stroke drive 3, and having a second tool portion in the form of a lower tool 5. The upper tool 4 is held in an upper tool holder 6 and the lower tool 5 is held in a lower tool holder 7. The two tool portions are arranged along a stroke axis 8 defined by the stroke drive 3 and are associated with sides of a metal sheet 9 to be processed which lie opposite each other along the stroke axis 8. In order to process the metal sheet 9, the metal sheet 9 supported on a workpiece table 10 is moved relative to the tool 2 by a coordinate guide 11.

The upper tool 4 can be raised and lowered along the stroke axis 8 by the stroke drive 3. In addition, the lower tool 5 can likewise be raised and lowered along the stroke axis 8 by a stroke drive 12. The upper tool 4 and the lower tool 5 are rotatable about a rotational axis 14 of the tool by a rotary drive 13 on the upper tool holder 6 and on the lower tool holder 7.

Indexing-switching devices 15 and 16 shown in simplified form as pinions are also provided on the upper tool holder 6 and on the lower tool holder 7.

All of the drives of the machine tool 1 are controlled by way of a central numerical control unit 17.

Figure 2:
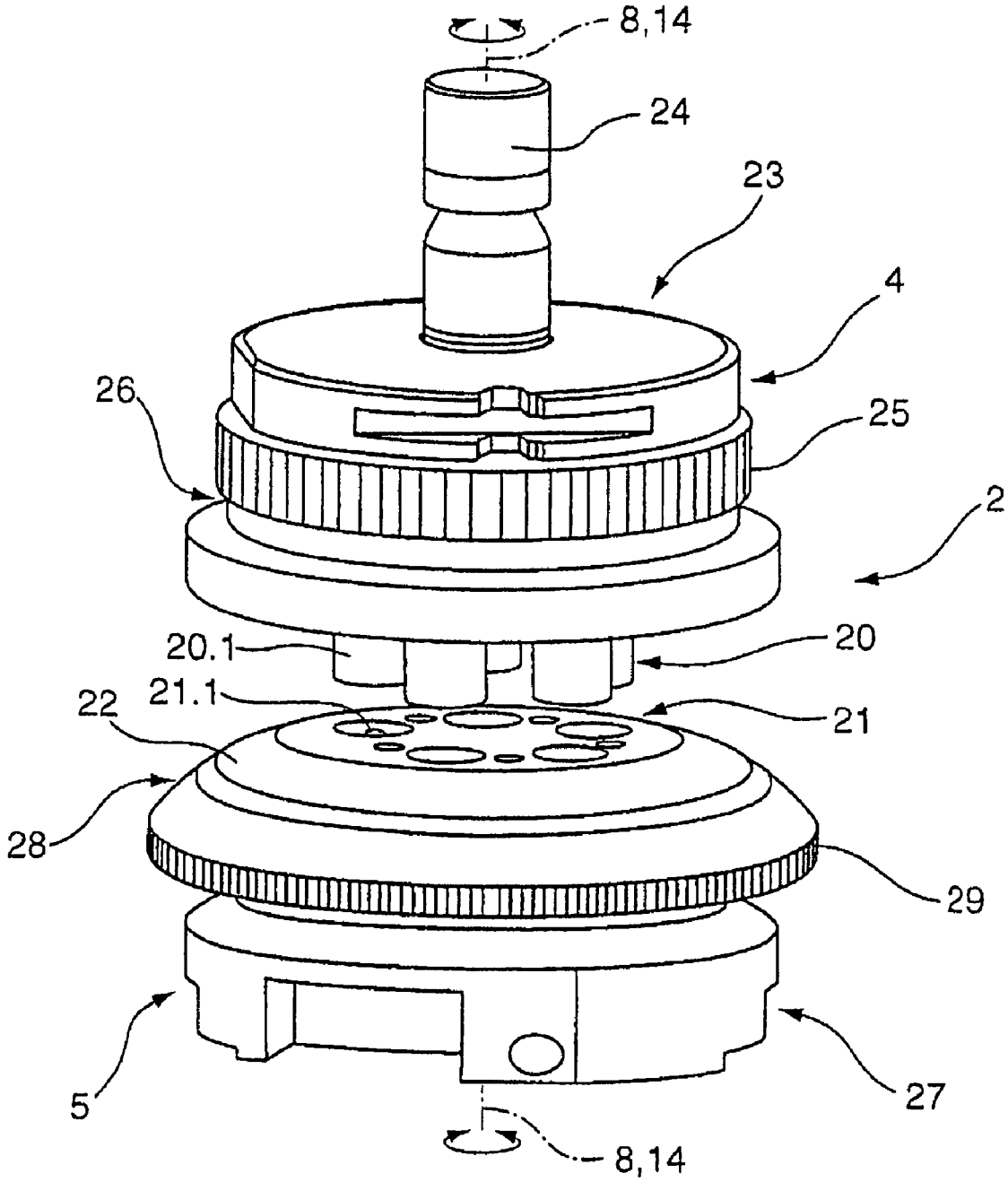
FIG. 2 shows the tool of FIG. 1, which includes an upper and a lower tool portion for forming metal sheets.

As shown in FIG. 2, the tool 2 has, on the upper tool 4, five different processing devices in the form of female forming dies to which, as a whole, the reference numeral 20 is allocated. A counter-device in the form of a male forming die on the lower tool 5 is associated with each of the female forming dies 20. The five male forming dies are indicated as a whole by the reference numeral 21 and are hidden in FIG. 2 by a workpiece support 22 of the lower tool 5. Only the tip of one male forming die 21.1 is visible in an opening of the workpiece support 22.

By the five different device pairings, protrusions having five different sizes can be produced in the metal sheet 9 to be processed without a tool change being necessary.

On a base body 23, the upper tool 4 has a shank 24 by which the upper tool 4 can be clamped in the upper tool holder 6. An activating member 26 provided with teeth 25 around its circumference is supported on the base body 23 of the upper tool 4 and is rotatable about the rotational axis 14 of the tool.

The lower tool 5 has a base body 27 on which an activating member 28 having teeth 29 around its circumference is disposed. The activating member 28 is rotatable about the rotational axis 14 of the tool.

The activating members 26 and 28 are parts of activating devices of the upper tool 4 and of the lower tool 5, the mode of operation of which is explained hereinafter.

Figure 3:
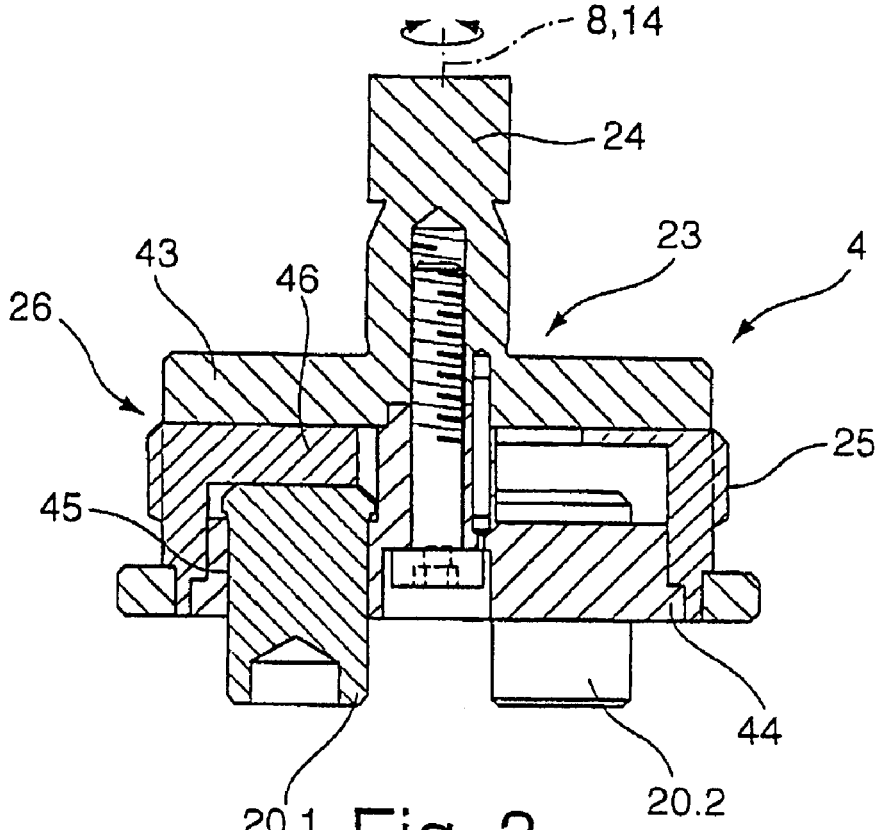
FIG. 3 is a sectional view of the upper tool portion of the tool of FIG. 2.
Figure 4:
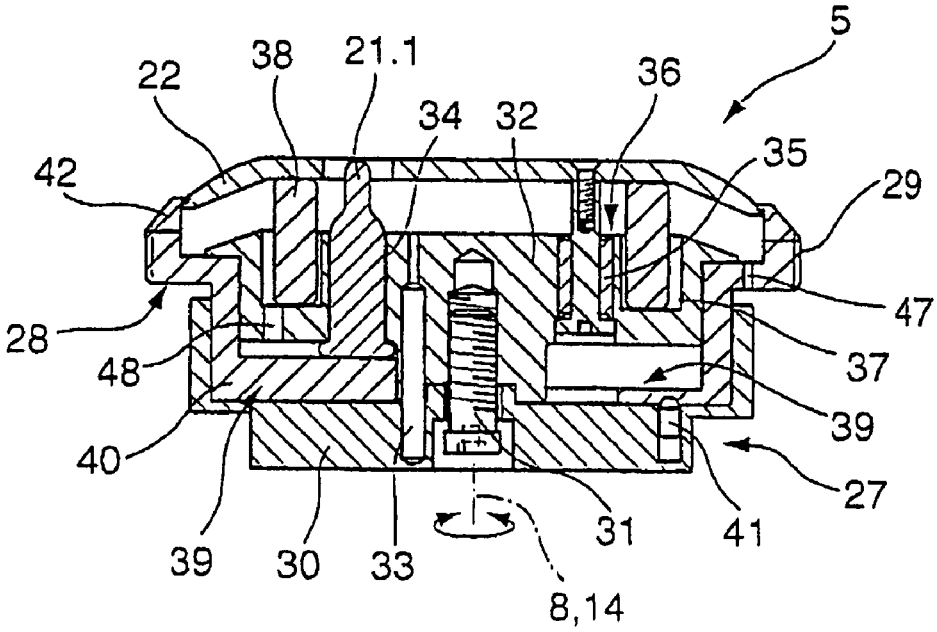
FIG. 4 is a sectional view of the lower tool portion of the tool of FIG. 2.

In FIGS. 3 and 4, the upper tool 4 and the lower tool 5 are shown in a sectional view along a device pairing activated for workpiece processing. The device pairing includes a female forming die 20.1 and the male forming die 21.1.

As shown in FIG. 4, the base body 27 of the lower tool 5 has a base plate 30 and a guide plate 32 connected to the base plate 30 by a screw 31. An anti-rotation member 33 fixes the guide plate 32 in a defined rotational position relative to the base plate 30.

The guide plate 32 has five guide bores 34 that follow one another along a circular path around the rotational axis 14 of the tool and of which one can be seen in FIG. 4. The guide bores 34 form slideways for the male forming dies 21 which are displaceable along the stroke axis 8 (i.e., parallel to the stroke axis 8) relative to the guide plate 32. Therefore, the male forming dies 21 are also arranged on a circular path around the rotational axis 14 of the tool.

Also provided on the guide plate 32 are five bushes 35 which are component parts of guides 36 for the workpiece support 22. An annular recess 37 on the upper side of the guide plate 32 is used to accommodate a resilient member in the form of an Eladur ring 38. The workpiece support 22 is supported resiliently on the guide plate 32 by the Eladur ring 38. Thus, starting from its resting position (shown in FIG. 4), the workpiece support 22 can perform a downwardly directed stroke movement against the resilient force of the Eladur ring 38.

The pot-like activating member 28 of the lower tool 5 is supported to be rotatable about the rotational axis 14 of the tool relative to the base plate 30 and the guide plate 32.

An annular base 39 of the activating member 28 rises in the circumferential direction in the manner of a ramp and has a top planar surface 40. The male forming die that is part of the activated device pairing is held in its operating position by the top planar surface 40 of the ramp portion of the annular base 39. As shown in FIG. 4, the male forming die 21.1 is located in its operating position close to the workpiece. When, during workpiece processing, the male forming die 21.1 is acted upon by a downwardly directed force, the top planar surface 40 of the ramp portion of the annular base 39 prevents the male forming die 21.1 from being displaced downwards into a non-operating position along the guide bore 34 extending parallel with the stroke axis 8.

In order to transfer the male forming die 21.1 into a non-operating position, the activating member 28 is rotated with an activating rotational movement about the rotational axis 14 of the tool until the ramp portion of the annular base 39 is no longer located beneath the male forming die 21.1. As a result, the male forming die 21.1 slides under the effect of gravity out of its operating position downwards into its non-operating position away from the workpiece. Instead of the male forming die 21.1, another of the male forming dies 21 is now activated for workpiece processing.

Under the conditions according to FIG. 4, the four non-activated male forming dies, which are not visible in FIG. 4, are in their non-operating position.

On the underside of the annular base 39, the lower tool 5 has multiple cavities in which, depending on the rotational position of the activating member 28, a spring-loaded locking ball 41 engages. The function of the locking ball 41 is described hereinafter in connection with the processes involved in the activating rotational movement.

By overlapping with the workpiece support 22, a protective ring 42 secured to the activating member 28 prevents dirt from penetrating between the workpiece support 22 and the activating member 28 into the interior of the lower tool 5.

Referring to FIG. 3, the base body 23 of the upper tool 4 is of similar construction to the base body 27 of the lower tool 5. It has a base plate 43 and a guide plate 44 that is connected to the base plate 43 and that is secured against rotation. The female forming dies 20 are supported in guide bores 45 of the guide plate 44 to be displaceable along the stroke axis 8.

The activating device of the upper tool 4 has, in with a similar manner to that of the activating device of the lower tool 5, a rotationally adjustable activating member 26 that is arranged between the base plate 43 and the guide plate 44 and that has a ramp portion with a bottom planar surface 46. The bottom planar surface 46 of the ramp portion, in the configuration shown in FIG. 3, is arranged above the female forming die 20.1. Consequently, the female forming die 20.1 remains in an operating position close to the workpiece even if acted upon by an upwardly directed force.

In the situation illustrated in FIG. 3, the four non-activated female forming dies are also in their operating positions. This can be seen, for example, by referring to the female forming die 20.2. If, however, they are acted upon by an upwardly directed force during workpiece processing, they move upwards out of their operating position and into a non-operating position. For example, such an application of force can be caused by a shaping already present on the metal sheet 9 to be processed.

In the following, an explanation is given, by way of example, of a processing operation carried out by activating the device pairing shown in FIGS. 3 and 4, which includes the male forming die 21.1 and the female forming die 20.1.

At the beginning of the process, the metal sheet 9 to be processed is positioned between the male forming die 21.1 and below the female forming die 20.1 (i.e., above the male forming die 21.1 and below the female forming die 20.1) by the coordinate guide 11. The metal sheet 9 to be processed rests on the workpiece support 22 of the lower tool 5. The upper tool 4 is then lowered by the stroke drive 3 together with the female forming dies 20, including the female forming die 20.1, along the stroke axis 8 (i.e., parallel to the stroke axis 8) towards the lower tool 5 until the female forming dies 20 come into contact with the upper side of the metal sheet 9.

Starting from this state, the actual working stroke, in which the upper tool 4 and the lower tool 5 are moved towards each other along the stroke axis 8, takes place. As this happens, the workpiece support 22 is pushed towards the guide plate 32 against the resilient force of the Eladur ring 38 due to the force transmitted via the metal sheet 9. At the same time, the male forming die 21.1 penetrates into the metal sheet 9 to be formed and, in so doing, forces a portion of the metal sheet 9 upwards into the female forming die 20.1. A protrusion is thus produced in the metal sheet 9.

Normally, the working stroke is performed by the stroke drive 3 for the upper tool 4. Alternatively, the working stroke can be effected by the stroke drive 12 for the lower tool 5 or in a combined manner by both stroke drives 3 and 12.

During the working stroke and the associated downward movement of the workpiece support 22, the inner volume of the lower tool 5 is reduced. Through-bores 47 and 48 enable the resultant compressed air to escape from the lower tool 5.

After the working stroke, the upper tool 4 and the lower tool 5 are moved apart from each other again along the stroke axis 8. The workpiece support 22 returns to its starting position under the action of the Eladur ring 38 and, in so doing, forces the processed metal sheet 9 off the male forming die 21.1. Accordingly, the workpiece support 22 acts as a workpiece stripper for the male forming dies 21.

Starting from the conditions illustrated in FIGS. 3 and 4, in order to activate another device pairing for workpiece processing, the rotationally adjustable activating member 28 of the lower tool 5 is rotated with an activating rotational movement relative to the male forming dies 21. This also involves a rotational movement of the activating member 28 relative to the base plate 30 of the guide plate 32 and to the workpiece support 22. The activating rotational movement takes place about the rotational axis 14 of the tool which therefore forms an activating rotational axis. The activating rotational movement ends as soon as the top planar surface 40 of the ramp portion of the activating member 28 is located under the male forming die to be activated.

In a comparable manner, the activating member 26 of the upper tool 4 is rotated with an activating rotational movement about the rotational axis 14 of the tool relative to the female forming dies 20 until the bottom planar surface 46 of the ramp portion of the activating member 26 is located above the female forming die to be activated.

The activating rotational movements of the activating member 28 are effected by the rotary drive 13 arranged at the machine side. In order to control the activating rotational movement, the activating member 28 has teeth 29 around its circumference. When the base body 27 of the lower tool 5 is rotated about the rotational axis 14 of the tool, the indexing-switching device 16 which is arranged at the machine side and which engages the teeth 29, and which is shown in the form of a pinion for the sake of simplicity, permits either a rotation of the activating member 28 simultaneously with the base body 27 (first switching state) or prevents the activating member 28 from performing a common rotational movement with the base body 27 (second switching state). If the activating member 28 is prevented from performing a rotational movement with the base body 27, a rotation of the base body 27 brings about a relative movement of the base body 27 and of the male forming dies 21 supported on the base body 27 with respect to the activating member 28.

The common rotation of the activating member 28 and the base body 27 when the indexing-switching device 16 is in the first switching state is used to orient the male forming dies 21 relative to the metal sheet 9 to be processed about the rotational axis 14 of the tool. During this operation, an undesirable rotation of the activating member 28 relative to the base body 27 is prevented by the locking ball 41.

The control of the activating rotational movement of the activating member 26 on the upper tool 4 by the indexing-switching device 15 is effected in with the same manner as the control of the activating rotational movement of the activating member 28 of the lower tool 5.

In order to simplify maintenance and repair, the base 39 of the activating member 28 of the lower tool 5 has openings through which, after the base plate 30 has been removed, male forming dies 21 to be exchanged can be removed downwards. The exchange of worn-out or destroyed male forming dies 21 can therefore take place in a simple manner after releasing the screw connection 31.

Modified structures of the tool 2 can have, for example, male punching dies and female punching dies instead of male forming dies and female forming dies. Furthermore, unlike the illustrated tool, the processing devices and/or the counter-devices can be returned to their non-operating position by resilient members.

Other embodiments are within the scope of the following claims.

What is claimed is:

1. A plate workpiece processing tool, comprising:

a first tool portion drivingly connectable to a stroke drive configured to move the first tool portion along a stroke axis;

a second tool portion, the first tool portion and the second tool portion being movable relative to one another along the stroke axis to enable a plate workpiece to be positioned between the first tool portion and the second tool portion;

a processing device connected to the first tool portion;

at least two counter-devices connected to the second tool portion, each counter-device being selectively alignable with the processing device, and a first rotatable activating member connected to the second tool portion and configured to move one of the at least two counter-devices into an operating position when the first rotatable activating member is rotated to a first position, the first rotatable activating member being configured to move another of the at least two counter devices into an operating position when the first rotatable activating member is rotated to a second position, the at least two counter-devices projecting toward the first tool portion to a greater extent when in the operating position than when in a non-operating position, wherein the processing device is movable towards the second tool portion in a direction substantially parallel to the stroke axis such that, when one of the at least two counter-devices is aligned with the processing device and is positioned in its operating position, the aligned processing device and counter-device are arranged to process a workpiece positioned between the first and second tool portions.

2. The tool of claim 1, further comprising at least two processing devices and a second rotatable activating member connected to the first tool portion, the second rotatable activating member being configured to move one of the at least two processing devices into an operating position when the second rotatable activating member is rotated to a first position, and the second rotatable activating member being configured to move another of the at least two processing devices into an operating position when the second rotatable activating member is rotated to a second position, wherein the at least two processing devices project towards the second tool portion to a greater extent when in the operating position than when in a non-operating position.

3. The tool of claim 2 configured such that, when one of the at least two processing devices is aligned with one of the at least two counter-devices, the first and second rotatable members are positionable to place the aligned processing device and counter-device in their operating positions.

4. The tool of claim 1, wherein the second tool portion comprises a workpiece support facing the first tool portion.

5. The tool of claim 4, wherein the second tool portion is configured so that the workpiece support strips the workpiece from the counter-device after workpiece processing.

6. The tool of claim 5, wherein the second tool portion comprises a resilient member disposed between the workpiece support and a base of the second tool portion, the resilient member being configured to move the workpiece support away from the base.

7. The tool of claim 1, wherein at least one of the counter-devices is configured to be moved into its non-operating position by gravity.

8. The tool of claim 1, wherein at least one of the counter-devices is in the form of a male processing die.

9. The tool of claim 8, wherein at least one of the counter-devices is in the form of a male forming die.

10. The machine of claim 8, further comprising a stroke drive connected to the second tool portion and configured to move the second tool portion along the stroke axis.

11. The tool of claim 1, wherein the counter-devices are arranged to follow each other around an axis about which the first activating member is rotated.

12. The tool of claim 1, wherein the first tool portion is positioned above the second tool portion.

13. A plate workpiece processing machine, comprising:

a rotary drive; and a tool comprising a first tool portion that is drivingly connected to a stroke drive configured to move the first tool portion along a stroke axis;

a second tool portion, the first tool portion and the second tool portion being movable relative to one another along the stroke axis to allow a plate workpiece to be positioned between the first tool portion and the second tool portion;

a processing device connected to the first tool portion;

at least two counter-devices connected to the second tool portion, each of the at least two counter-devices being selectively alignable with the processing device; and a first rotatable activating member connected to the second tool portion and configured to be rotated by the rotary drive, the first rotatable activating member being configured to move one of the at least two counter-devices into an operating position when the first rotatable activating member is rotated by the rotary drive to a first position, and the first rotatable activating member being configured to move another of the at least two counter devices into an operating position when the first rotatable activating member is rotated by the rotary drive to a second position, wherein the at least two counter-devices project towards the first tool portion to a greater extent when in the operating position than when in a non-operating position;

wherein the processing device is movable towards the second tool portion in a direction substantially parallel to the stroke axis such that, when one of the at least two counter-devices is aligned with the processing device and is positioned in its operating position, the aligned processing device and counter-device are arranged to process a workpiece positioned between the aligned processing device and counter-device.

14. The machine of claim 13, wherein the first rotatable activating member and the first and second tool portions are rotatable about a rotational axis of the tool by the rotary drive.

15. The machine of claim 13, further comprising an indexing-switching device connected to the second tool portion and moveable between first and second switching states, wherein, in the first switching state, the counter-devices and the rotatable activating member are rotationally fixed relative to one another and are rotatable by the rotary drive and wherein, in the second switching state, the counter-devices and the rotatable activating member are rotatable relative to each other with a rotational movement provided by the rotary drive.

16. The machine of claim 13, wherein at least two processing devices and a second rotatable activating member are connected to the first tool portion, the second rotatable activating member is configured to move one of the at least two processing devices into an operating position when the second rotatable activating member is rotated by the rotary drive to a first position, and the second rotatable activating member is configured to move another of the at least two processing devices into an operating position when the second rotatable activating member is rotated by the rotary drive to a second position, the at least two processing devices projecting toward the second tool portion to a greater extent when in the operating position than when in a non-operating position.

17. The machine of claim 16 configured such that, when one of the at least two processing devices is aligned with one of the at least two counter-devices, the first and second rotatable members are positionable to place the aligned processing device and counter-device in their operating positions.

18. The machine of claim 13, further comprising an indexing-switching device connected to the first tool portion and moveable between first and second switching states, wherein, in the first switching state, the processing devices and the rotatable activating member are rotatably fixed relative to one another and are rotatable by the rotary drive and wherein, in the second switching state, the processing devices and the rotatable activating member are rotatable relative to each other with a rotational movement provided by the rotary drive.

* * * * *

UNITED STATES PATENT AND TRADEMARK OFFICE

CERTIFICATE OF CORRECTION

PATENT NO. : 8,201,435 B2
APPLICATION NO. : 12/424802
DATED : June 19, 2012
INVENTOR(S) : Werner Erlenmaier It is certified that error appears in the above-identified patent and that said Letters Patent is hereby corrected as shown below:

Column 10, line 19 (Claim 10, line 19), delete "machine" and insert --tool--.

Signed and Sealed this
Fifteenth Day of January, 2013

David J. Kappos

David J. Kappos
*Director of the United States Patent and Trademark Office*